US005496024A

United States Patent [19]

Luethi et al.

[11] Patent Number: 5,496,024

[45] Date of Patent: Mar. 5, 1996

[54] CONVEYING DEVICE FOR TRANSPORTING PRINTED PRODUCTS ALONG A CONVEYING CHANNEL HAVING AN UPSTREAM END REGION WITH ADJUSTABLE HEIGHT

[75] Inventors: Ernst Luethi, Brittnau; Daniel Langenegger, Strengelbach, both of Switzerland

[73] Assignee: Grapha-Holding AG, Hergiswil, Switzerland

[21] Appl. No.: 195,284

[22] Filed: Feb. 14, 1994

[30] Foreign Application Priority Data

Feb. 18, 1993 [CH] Switzerland ..... 496/93

[51] Int. Cl.[6] ..... B65H 5/02

[52] U.S. Cl. ..... 271/273; 271/275; 271/198

[58] Field of Search ..... 271/273, 274, 271/275, 198

[56] References Cited

U.S. PATENT DOCUMENTS

| | | | |
|---|---|---|---|
| 2,391,170 | 12/1945 | Labombarde | 271/198 X |
| 3,871,644 | 3/1975 | Stobb | 271/198 |
| 4,385,537 | 5/1983 | Wolf | 271/273 X |
| 4,973,039 | 11/1990 | Jeske et al. | 271/273 X |
| 5,094,443 | 3/1992 | Young . | |

FOREIGN PATENT DOCUMENTS

| | | | |
|---|---|---|---|
| 2315467 | 1/1977 | France . | |
| 184440 | 6/1906 | Germany . | |
| 714835 | 11/1941 | Germany | 271/198 |
| 7110017 | 7/1971 | Germany . | |
| 3226627 | 2/1983 | Germany . | |

*Primary Examiner*—David H. Bollinger
*Attorney, Agent, or Firm*—Spencer & Frank

[57] ABSTRACT

To transport flat printed products lying on a support formed by a driven first belt, and moved forward in a conveying channel by means of the run of a second belt disposed above the first, the entrance region of the channel is configured to be adjustable in height in the cadence of the supplied printed products.

8 Claims, 3 Drawing Sheets

1
10
18
19
M
17
16
15
20
9
P
9
8
5
4
7
13
14
11
3
12
6

CONVEYING DEVICE FOR TRANSPORTING PRINTED PRODUCTS ALONG A CONVEYING CHANNEL HAVING AN UPSTREAM END REGION WITH ADJUSTABLE HEIGHT

CROSS-REFERENCE TO RELATED APPLICATION

This application claims the priority of patent application Ser. No. 00 496/93-6, filed Feb. 18, 1993, in switzerland, the subject matter of which is incorporated herein by reference.

BACKGROUND OF THE INVENTION

The present invention relates to a conveying device for transporting printed products regularly following one another on a flat support formed by at least one first, driven belt, the conveying device including a run of at least one second belt, the run being disposed above the support, driven uniformly and, with the support, forming a croonraying channel.

Conveying devices of the above-described type are used, among other places, at transfer locations between further-processing machines and devices, for example between a cyclical transporter and a page-cutting device, where stitched printed products pass through the last processing station. The supply of printed products in imbricated form or individually is effected continuously in a preset working cadence to which the conveying device mentioned at the outset is extensively bound.

The conveying device assumes the task of reliably transporting the printed products in a certain position to the page-cutting device or the following processing station, respectively, to prevent disturbances in the subsequent work process.

It is the case in a known conveying device of the type mentioned at the outset that, because of their uneven thickness, the printed products supplied lying flat and having the fold forward are interfered with particularly at their folded edges by the upper entrance edge of the conveying channel, and are thus displaced from their prescribed position. Consequently the work cycle is interrupted or the side edges of the printed products are insufficiently cut.

SUMMARY OF THE INVENTION

It is therefore an object of the present invention to create a conveying device with which the above-described disadvantages do not occur and which ensures reliable transport of the printed products.

This object is attained in accordance with the invention in that the height of the conveying channel is adjustable in the end region located upstream in the cadence of the supplied printed products.

Thus, the printed products can be received in the correct position by the conveying device and further transported, and the conveying device can adapt itself each time to the different thicknesses of the printed products.

BRIEF DESCRIPTION OF THE DRAWINGS

The invention is described in detail below by way of two embodiments.

DETAILED DESCRIPTION OF THE PREFERRED EMBODIMENTS

Figure 1:
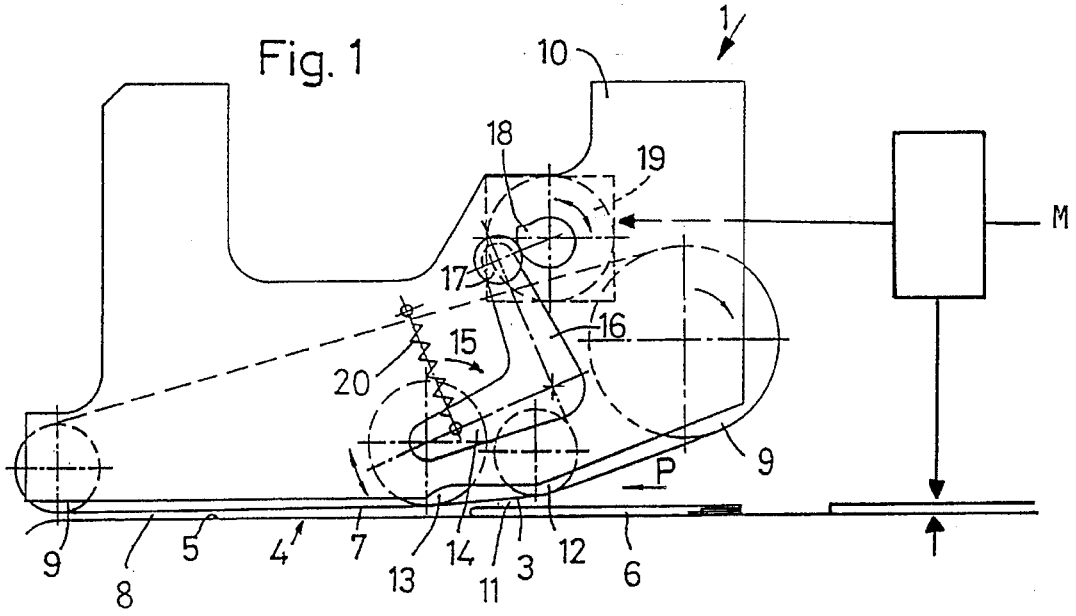
FIG. 1 is a side view of an embodiment of the invention
Figure 2:
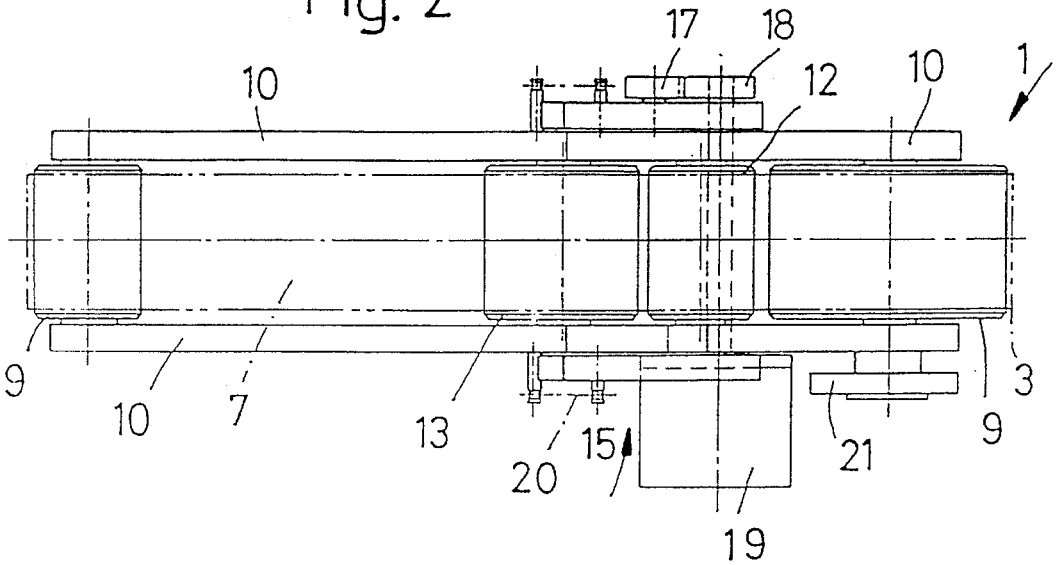
FIG. 2 is a view from below of the embodiment in accordance with FIG. 1

FIGS. 1 and 2 show a conveyor arrangement 1 of a partially shown conveying device, the arrangement being formed by an endless, circulating upper second belt 3 that cooperates with an endless, circulating lower first belt 4. The first belt 4 forms a flat support 5, on which the printed products 6, supplied with the fold forward, are deposited, for example, from a transporter, regularly or cyclically, individually or in imbricated form, in the direction of the arrow P. Above the support 5, which is formed by at least one run of the circulating, driven first belt 4, a run 7 of the second endless, circulating belt 3 extends approximately parallel in the same direction of motion as the first belt 5 that forms the support. In the region of support 5, the two belts 3 and 4 form a conveying channel 8, whose passage height can be adjusted to conform to the thickness of the supplied printed products 6 by means of height adjusters (not shown) of a stand 10 that supports the second belt 3 and its guiding and driving means 9.

The conveying channel 8 is configured to be adjustable in height in the upstream entrance region 11, which is defined by two spaced guide rollers 12 and 13. In the case illustrated, in FIG. 1, guide roller 13 rests against the rear side of the run 7 and, as can be seen, presses it toward the support 5 in the cadence of the supplied printed products, so that an increasingly narrow entrance region 11 results at the entrance of the conveying channel in the conveying direction of the printed products. The effect of this measure is that the printed products 6 are taken gently into the conveying channel 8 and conveyed further without their position being changed.

It would also be possible to achieve at least a similar effect with upstream guide roller 12.

Guide roller 13 is freely rotatably seated on a lever arm 14 of a two-armed lever arrangement 15, whose other lever arm 16 is pressed onto the control shaft 18 of an adjustment drive 19 by means of a tension spring 20 that engages lever arm 14 by way of a control roller 17. For this purpose, in the region of the contacting control roller 17, the cross-section of the control shaft 18 is configured to be increasingly eccentric in one direction of rotation and is drivable in both directions. The lever arrangement 15 of FIG. 2 is provided on both sides of the conveying device 1 to avoid torques. For the sake of completeness, it is pointed out that the second belt 3 is driven by a driving wheel 21 on the shaft of the guiding and driving means 9. Adjustment drive 19 is responsive to a measuring device M which measures the thickness of the printed products for controlling the position of roller 13 by way of control shaft 18 and lever arrangement 15.

Figure 4:
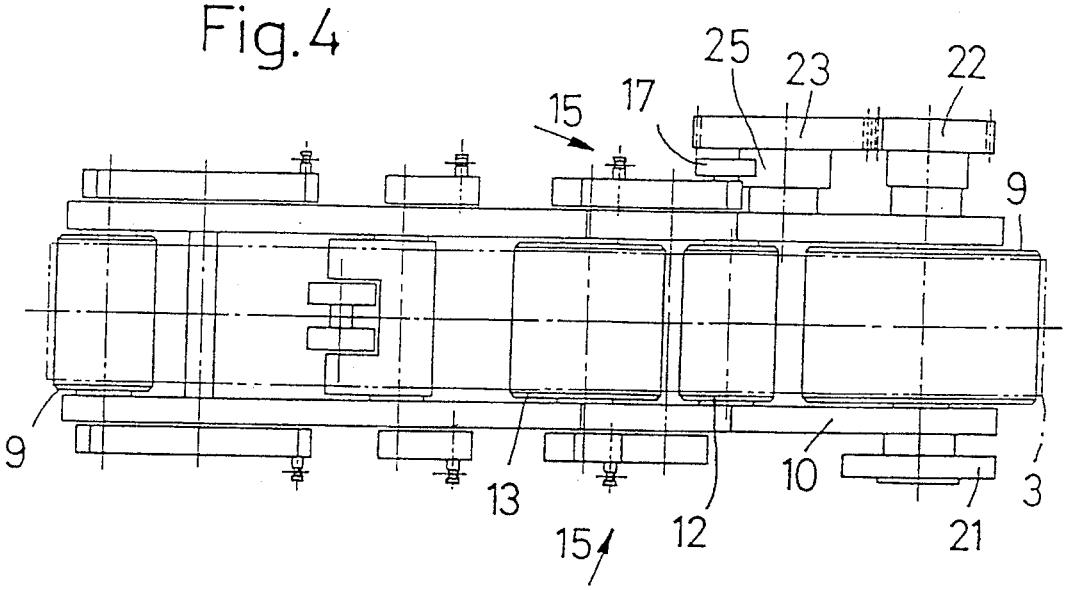
FIG. 4 is a view from below of the embodiment in accordance with FIG. 3.
Figure 3:
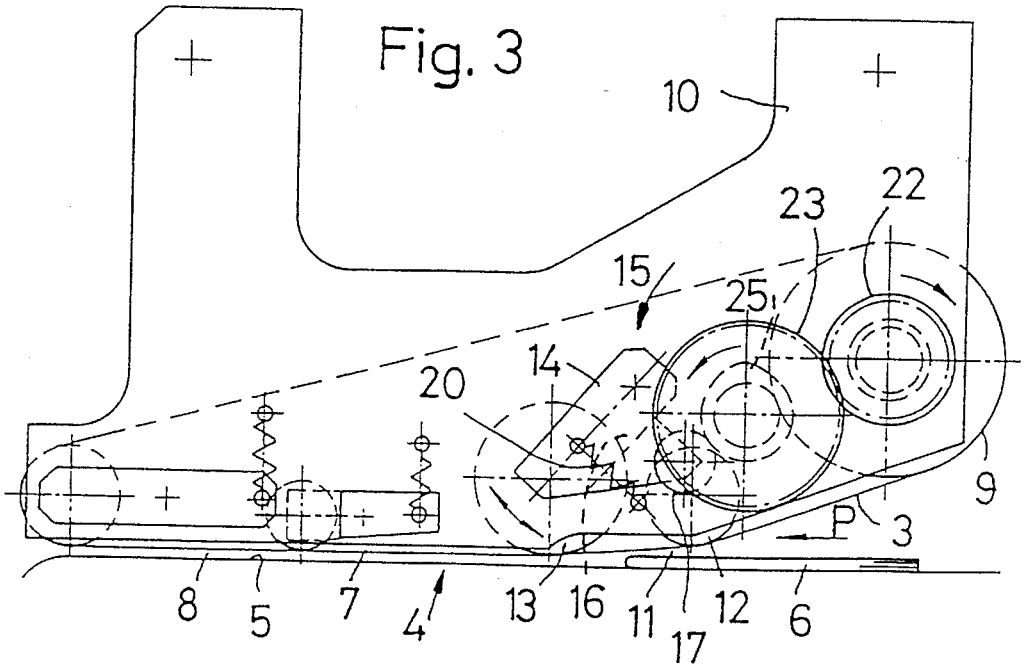
FIG. 3 is a side view of a further embodiment of the invention

In a further embodiment of the conveying device of the invention, in accordance with FIGS. 3 and 4, the change in the entrance region 11 of the conveying channel 8 takes place in direct dependence on the drive of the second belt 3. In this instance a pinion 22, which, together with a meshing pinion 23 that is is seated on the shaft of the driving wheel 21, forms a transmission gear. A control cam 25 is located on the cyclically driven control shaft of the pinion 23; a control roller 17 leans against this cam with the aid of a tension spring 30 in order to operate the guide roller 13, which is disposed at the rear side of run 17, by means of lever arm 14, via the lever arm 16 of a lever arrangement 15, with this lever arm 16 being associated with the tension spring.

It will be understood that the above description of the present invention is susceptible to various modifications, changes and adaptations, and the same are intended to be comprehended within the meaning and range of equivalents of the appended claims.

What is claimed is:

1. In a conveying device for transporting printed products regularly following one another on a flat support formed by at least one first, driven belt, the conveying device including a run of at least one second belt, with the run being disposed above the support, driven uniformly with the support, and forming a conveying channel with the support, the improvement comprising means for periodically adjusting the height of the conveying channel in an upstream end region of the conveying channel, the periodic adjusting corresponding to a cadence of the supplied printed products.

2. A conveying device as defined in claim 1, wherein the height of the end region increases toward an upstream entry opening of the conveying channel.

3. A conveying device as defined in claim 1, wherein the height adjusting means includes two rollers resting against a rear side of the run formed by the second belt.

4. A conveying device as defined in claim 3, wherein the height adjusting means further includes means for driving at least one of the rollers to vary the height of the conveying channel.

5. A conveying device as defined in claim 4, further comprising means for measuring the thickness of the printed products, said means for measuring being coupled to the driving means for controlling a position of said at least one roller.

6. A conveying device as defined in claim 5, wherein said height adjusting means includes an adjustment motor having a drive shaft, a cam connected to the drive shaft and a double lever resting yieldingly against the cam with the at least one roller being rotatably seated on a free lever end of the double lever.

7. A conveying device as define in claim 4, wherein said height adjusting means includes a cyclically driven control shaft and a double lever resting yieldingly against the cyclically driven control shaft, with said at least one roller being sealed at a free lever end of the double lever.

8. A conveying device as defined in claim 7, wherein the control shaft is connected to be driven by means of a transmission gear together with the second belt.

* * * * *